US006499449B2

(12) United States Patent
Michelini et al.

(10) Patent No.: US 6,499,449 B2
(45) Date of Patent: Dec. 31, 2002

(54) METHOD AND SYSTEM FOR OPERATING VARIABLE DISPLACEMENT INTERNAL COMBUSTION ENGINE

(75) Inventors: John Ottavio Michelini, Sterling Heights, MI (US); Stephen Lee Cooper, Dearborn, MI (US); Shunsuke Okubo, Farmington Hills, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/769,156

(22) Filed: Jan. 25, 2001

(65) Prior Publication Data

US 2002/0096134 A1 Jul. 25, 2002

(51) Int. Cl.[7] ..... F01L 1/34

(52) U.S. Cl. ..... 123/90.15; 123/90.17; 123/90.16; 123/481; 123/198 F; 123/406.23; 123/361; 123/436

(58) Field of Search ..... 123/90.15, 90.16, 123/90.17, 90.18, 481, 198 F, 406.23, 399, 361, 436; 701/110, 115

(56) References Cited

U.S. PATENT DOCUMENTS

| | | | | |
|---|---|---|---|---|
| 5,374,224 A | | 12/1994 | Huffmaster et al. | |
| 5,398,544 A | | 3/1995 | Lipinski et al. | |
| 5,408,966 A | | 4/1995 | Lipinski et al. | |
| 5,408,974 A | | 4/1995 | Lipinski et al. | |
| 5,431,139 A | | 7/1995 | Grutter et al. | |
| 5,437,253 A | | 8/1995 | Huffmaster et al. | |
| 5,490,486 A | * | 2/1996 | Diggs | 123/198 F |
| 5,548,995 A | | 8/1996 | Clinton et al. | |
| 5,642,703 A | | 7/1997 | Stockhausen et al. | |
| 5,832,885 A | * | 11/1998 | Moyer | 123/90.14 |
| 5,927,238 A | * | 7/1999 | Watson | 123/90.15 |
| 5,934,263 A | | 8/1999 | Russ et al. | |
| 5,992,361 A | * | 11/1999 | Murata | 123/90.17 |
| 5,992,390 A | * | 11/1999 | Moyer | 123/198 F |
| 6,006,725 A | * | 12/1999 | Stefanopoulou | 123/399 |

FOREIGN PATENT DOCUMENTS

| | | |
|---|---|---|
| DE | 44 35 741 C | 5/1906 |
| DE | 199 28 560 A | 12/2000 |
| DE | 19928560 A1 | 12/2000 |
| JP | 60 150412 A | 8/1985 |

OTHER PUBLICATIONS

*Journal of Dynamic systems, Measurement, and Control*, Jun. 1998, vol. 120, pp. 257–256—Controlled–Oriented Model of a Dual Equal Variable Cam Timing Spark Ignition Engine, A. G. Stefanopoulou et al.

* cited by examiner

*Primary Examiner*—Thomas Denion
*Assistant Examiner*—Jaime Corrigan
(74) *Attorney, Agent, or Firm*—Carlos L. Hanze

(57) ABSTRACT

A method of operating an internal combustion engine having a variable cam timing mechanism in cooperation with a plurality of deactivatable cylinders and corresponding intake valves includes the steps of scheduling a transition mode of the engine, determining a desired engine torque during the transition mode, determining a VCT phase angle based on the desired engine torque and operating the variable cam timing mechanism in accordance with the VCT phase angle to provide the desired engine torque during the transition mode.

15 Claims, 4 Drawing Sheets

METHOD AND SYSTEM FOR OPERATING VARIABLE DISPLACEMENT INTERNAL COMBUSTION ENGINE

BACKGROUND OF THE INVENTION

1. Field of the Invention

The present invention relates generally to a method and system for operating of an internal combustion engine having one or more deactivatable cylinders. More particularly, the invention relates to a method and system for transitioning operation of a variable displacement internal combustion engine so as to reduce undesired engine torque responses occurring during displacement mode transitions of the engine.

2. Background Art

Variable displacement internal combustion engines have been developed to provide maximum engine torque output while operating the engine with a full complement of so-called "activated" or "enabled" cylinders, and to minimize vehicle fuel consumption and exhaust emissions while operating the engine with a fewer number of activated cylinders. During high speed, high load operating conditions, for example, all cylinders are usually activated as required to provide maximum torque. During low speed, low load conditions, however, individual or banks of cylinders are deactivated in order to minimize fuel consumption and reduce emissions. Variable displacement capabilities can be combined, for example with variable cam timing (VCT), to further improve the fuel economy and emissions performance of the vehicle.

A problem with conventional variable displacement engines (VDE's), however, occurs when transitioning engine operation between various displacement modes, e.g., full cylinder mode to a reduced cylinder mode and visa-versa. During transitions, during which the number of activated cylinders is increased or decreased, the driver-demanded torque must be maintained for the transition to remain imperceptible to the driver. When transitioning from full cylinder mode to a reduced cylinder mode, for example, a powertrain control problem arises in that the manifold pressure required to maintain a constant driver-demanded torque output is different than that required in full cylinder mode. This is so because the per cylinder load changes with the number of activated and deactivated cylinders. Likewise, when transitioning from a reduced cylinder mode to full cylinder mode, a different manifold pressure is required.

Undesired torque disturbances during transitions can be minimized by properly operating an engine's electronic throttle. A problem with such a method however is that manifold pressure cannot change instantaneously. Thus, a transition from one cylinder mode to another will cause the torque output of the engine to surge or lag the driver-demanded torque until the manifold pressure can be regulated using the electronic throttle.

A known solution to this problem is to control the electronic throttle to establish a target or adjusted manifold absolute pressure (MAP) just prior to a transition from one cylinder mode to another. After the MAP has been adjusted, designated cylinders are deactivated and the engine is placed in reduced cylinder mode. Thereby, when the engine is transitioned to the reduced cylinder mode, the engine's intake manifold is filled as required to maintain the driver-demanded engine torque immediately upon cylinder deactivation. Similarly, when transitioning from a reduced to a full cylinder mode, the MAP is lowered to maintain the driver-demanded engine torque immediately upon cylinder activation. In either case however, the adjusted MAP still often yields an engine torque that is either in excess or below the driver-demanded engine torque.

To compensate for the adjusted MAP, spark retard techniques are used to maintain the driver-demanded torque during cylinder mode transitions. See, for example, U.S. Pat. Nos. 5,374,224 and 5,437,253 assigned to the assignee of the present invention. In the case of a transition from full to reduced cylinder mode, for example, spark retard is used to reduce engine torque just prior to cylinder deactivation. However, combustion instability introduced by the spark retard serves to limit the amount of torque reduction achievable with these techniques.

Accordingly, with a variable displacement internal combustion engine having a VCT mechanism, the inventors herein have recognized that the VCT mechanism itself can be used to more accurately control engine torque output during transitions to and from reduced cylinder mode operation of the engine.

SUMMARY OF THE INVENTION

The aforedescribed limitations of conventional control methods and systems are substantially overcome by the present invention, in which a method is provided for operating an internal combustion engine having a variable cam timing mechanism in cooperation with a plurality of deactivatable cylinders and corresponding intake valves. The method includes the steps of scheduling a transition mode of the engine, determining a desired engine torque during the transition mode, determining a VCT phase angle based on the desired engine torque, and operating the variable cam timing mechanism in accordance with the VCT phase angle to provide the desired engine torque output during the transition mode. Preferably, the step of determining the desired engine torque includes determining a desired cylinder air charge required to produce the desired engine torque. The desired air charge is then used to select the VCT phase angle required to operate the VCT mechanism to provide the desired engine torque output during the transition mode.

A corresponding system is also provided for operating an internal combustion engine having an intake manifold, an electronic throttle, an ignition system and a variable cam timing mechanism in cooperation with a plurality of deactivatable cylinders and corresponding intake valves. The system includes a manifold absolute pressure (MAP) sensor disposed in the intake manifold and a controller coupled to the MAP sensor for receiving a signal from the MAP sensor. Alternatively, one or more sensors are provided for inferring MAP. The controller includes computer program code and databases for determining an occurrence of a transition mode of the engine, determining a desired engine torque during the transition mode, determining a VCT phase angle based on the desired engine torque, and for operating the VCT mechanism in accordance with the VCT phase angle to provide the desired engine torque during the transition mode.

An advantage of the above-described method and system is that a VCT mechanism can be used to minimize the effects of undesired engine torque perturbations, fluctuations, disturbances and the like occurring during transitions between operating modes of a variable displacement engine (VDE). Specifically, by operating a VCT mechanism in accordance with the present invention, manifold air pressure can be more accurately controlled during transitions of the VDE engine from a full cylinder mode to a reduced cylinder mode and visa-versa. Dual equal variable cam timing (DEVCT) actuators, for example, can be used to control the relationship between cylinder load and manifold vacuum by varying the relative phase angle of the cam with respect to base timing to avoid undesired torque responses by the engine. When transitioning from a full cylinder mode to a reduced cylinder mode, for example, cam retard can be scheduled to reduce engine torque output when the manifold air pressure is higher than what it should be for a desired, driver-commanded torque output.

In addition, the method of the present invention can be combined with conventional spark retard techniques to provide more improved torque response without significantly impacting combustion stability.

Further objects, features and advantages of the invention will become apparent from the following detailed description of the invention taken in conjunction with the accompanying figures showing illustrative embodiments of the invention.

BRIEF DESCRIPTION OF THE DRAWINGS

For a complete understanding of the present invention and the advantages thereof, reference is now made to the following description taken in conjunction with the accompanying drawings in which like reference numerals indicate like features and wherein.

DETAILED DESCRIPTION OF THE PREFERRED EMBODIMENTS

Figure 1:
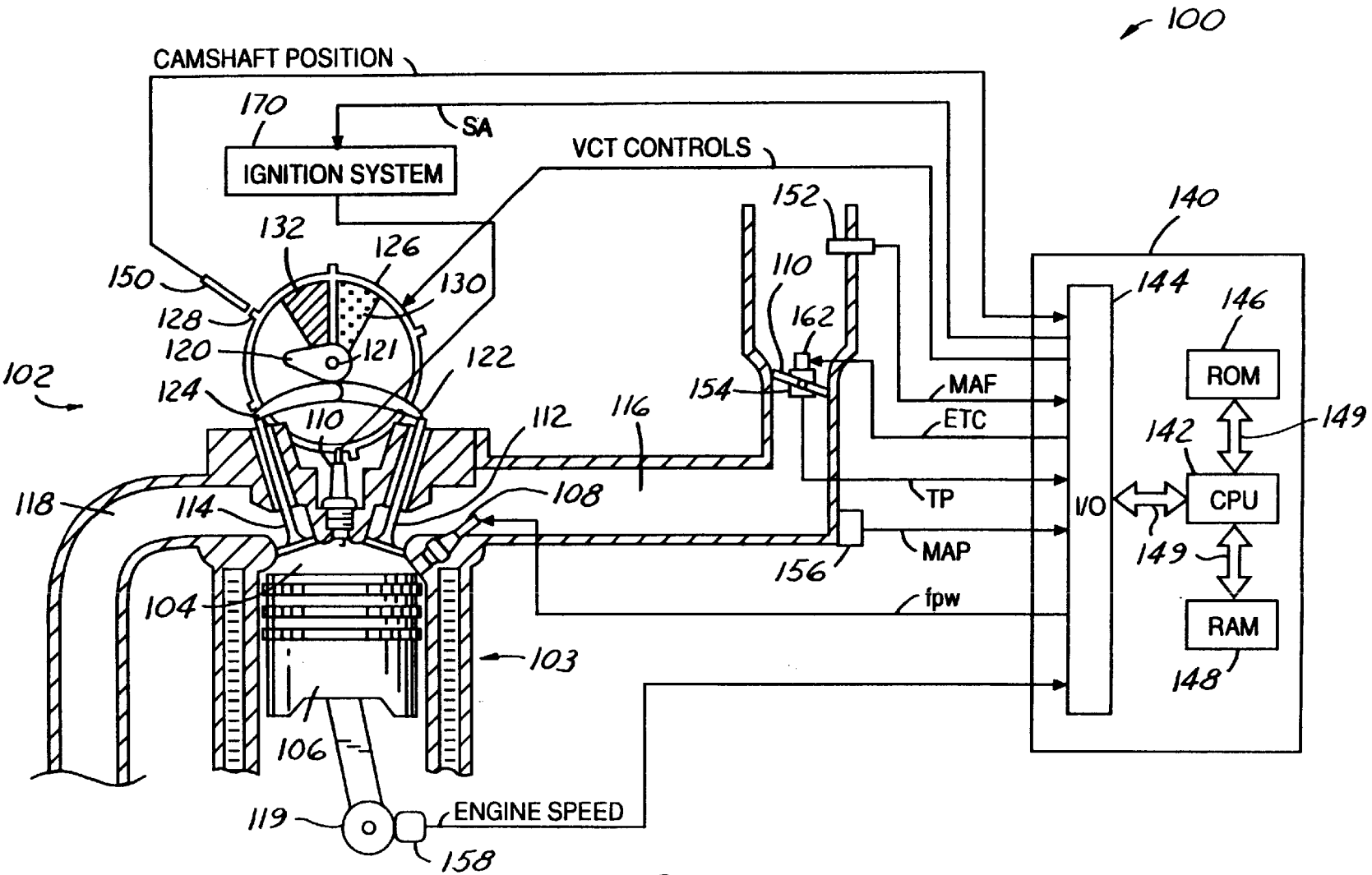
FIG. 1 is a schematic diagram of system for transitioning operation of a variable displacement engine in accordance with a preferred embodiment of the present invention.

FIG. 1 shows a schematic diagram of a system 100 for transitioning operation of variable displacement engine (VDE) 102 in accordance with a preferred embodiment of the present invention. The engine 102 shown in FIG. 1, by way of example and not limitation, is a gasoline four-stroke direct fuel injection (DFI) internal combustion engine having a plurality of deactivatable cylinders (only 103 shown), each of the cylinders having a combustion chamber 104 and a corresponding reciprocating piston 106, fuel injector 108, spark plug 110 and intake and exhaust valves 112 and 114, respectively, for communicating with intake and exhaust manifolds 116 and 118. The engine 102, however, can be any internal combustion engine of any suitable configuration, such as a port fuel injection (PFI), having one or more deactivatable cylinders, reciprocating pistons and multiple cooperating intake and exhaust valves for each cylinder.

Continuing with FIG. 1, the engine 102 further includes a crankshaft 119 in communication with a camshaft 121. The camshaft 121 includes a cam 120 in communication with rocker arms 122 and 124 for actuating intake and exhaust valves 112 and 114, respectively. The camshaft 121 is directly coupled to a housing 126, itself having a plurality of tooth-like structures 128 (five shown by way of example only) for cylinder identification and for measuring the angular position of the camshaft 121 relative to the crankshaft 119. The housing 126 is hydraulically coupled via advance and retard chambers 130 and 132 to the camshaft 121, which in turn is coupled to the crankshaft 119 via a timing chain (not shown).

As such, the relative angular position of the camshaft 121 to the crankshaft 119, or so-called "cam phase angle" or "VCT phase angle", can be varied by hydraulically actuating camshaft 121 via advance and retard chambers 130 and 132. The VCT phase angle is advanced by providing highly pressurized fluid to advance chamber 130, and retarded by providing highly pressurized fluid to retard chamber 132. Thus, by providing appropriate VCT phase angle control signals, intake and exhaust valves 112 and 114 valves can be opened and closed at earlier (advance) or later (retard) times relative to the crankshaft 119.

Referring again to FIG. 1, the system in accordance with the present invention further includes a controller 140 for controlling the overall operation of the engine 102, including providing the appropriate VCT phase angle control signals, and for performing the methods of the present invention described in detail below with reference to FIGS. 2 through 7. The controller 140, which can be any suitable powertrain controller or microprocessor-based module, includes a central processing unit (CPU) 142, a data bus 149 of any suitable configuration, corresponding input/output ports 144, random-access memory (RAM) 148, and read-only memory (ROM) or equivalent electronic storage medium 146 containing processor-executable instructions and database values for controlling engine operation in accordance with FIGS. 2 through 7. The controller 140 receives various signals from conventional sensors coupled to the engine 102, the sensors including but not limited to: a camshaft position sensor 150 for measuring the angular position of the camshaft 121; a mass air flow (MAF) sensor 152 for measuring the inducted mass air flow of the engine; a throttle position sensor 154 for indicating a throttle position (TP); a sensor 156 for measuring the manifold absolute pressure (MAP) of the engine; and a speed sensor 158 for measuring engine speed. Alternatively, one or more sensors are provided for inferring MAP.

In addition, the controller 140 generates numerous controls signals, including but not limited to: a spark advance signal (SA) for controlling spark ignition timing via conventional distributorless ignition system 170; VCT controls signal(s) for varying the position of the camshaft relative to the crankshaft; an electronic throttle control (ETC) signal for controlling the operation of an electric motor 162 used to actuate a throttle plate 160; and a fuel control signal (fpw) for controlling the amount of fuel to be delivered by fuel injector 108.

Figure 2:
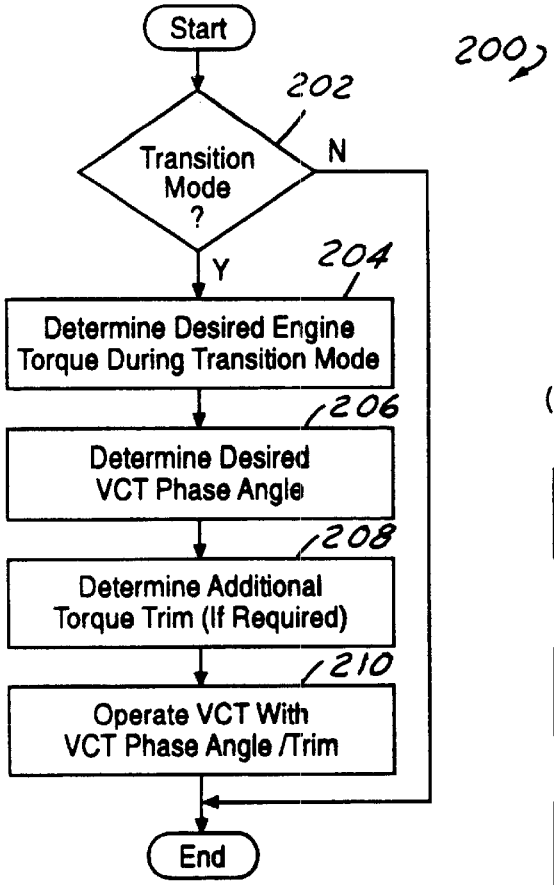
FIG. 2 is flow diagram of a preferred method for transitioning operation of a variable displacement engine.

FIG. 2 shows a flow diagram of a preferred method 200 for transitioning operation of a variable displacement engine in accordance with the present invention. The method includes the steps of scheduling a transition mode of the engine, step 202, determining a desired, "driver-demanded" engine torque during the transition mode, step 204, determining a VCT phase angle based on the desired engine torque, step 206, and operating the variable cam timing mechanism in accordance with the VCT phase angle to provide the desired engine torque during the transition mode, step 212. Optionally, if it is determined that additional torque correction is required in addition to that provided by the VCT phase angle, an additional torque trim is applied during the transition mode.

Figure 3:
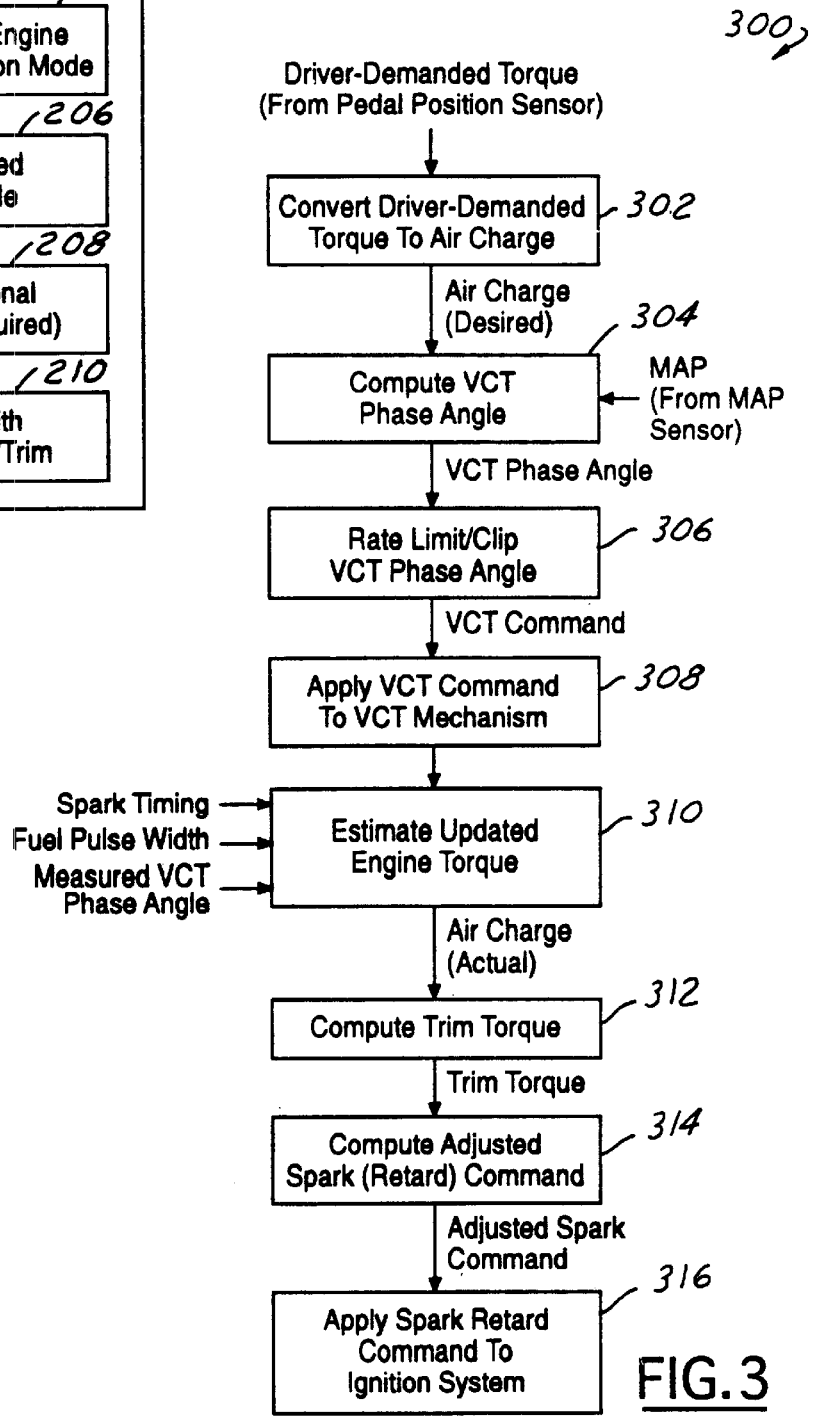
FIG. 3 is a further detailed schematic diagram of the method of FIG. 2.

With reference also to FIG. 3, which shows a further detailed schematic diagram of the method of FIG. 2, step 204 is preferably performed by using conventional methods to convert the desired engine torque to a desired cylinder air charge, step 302, required to deliver the desired engine torque. Nominally, as part of step 302, the desired torque is compensated in order to take into account certain losses. The desired air charge, which is preferably derived using a look-up table stored in controller memory, is in turn used along with an inferred or actual manifold absolute pressure (MAP) reading to derive a VCT phase angle, step 304. Plots representing a family of exemplary look-up tables of VCT phase angle versus air charge are shown in FIG. 4.

Figure 4:
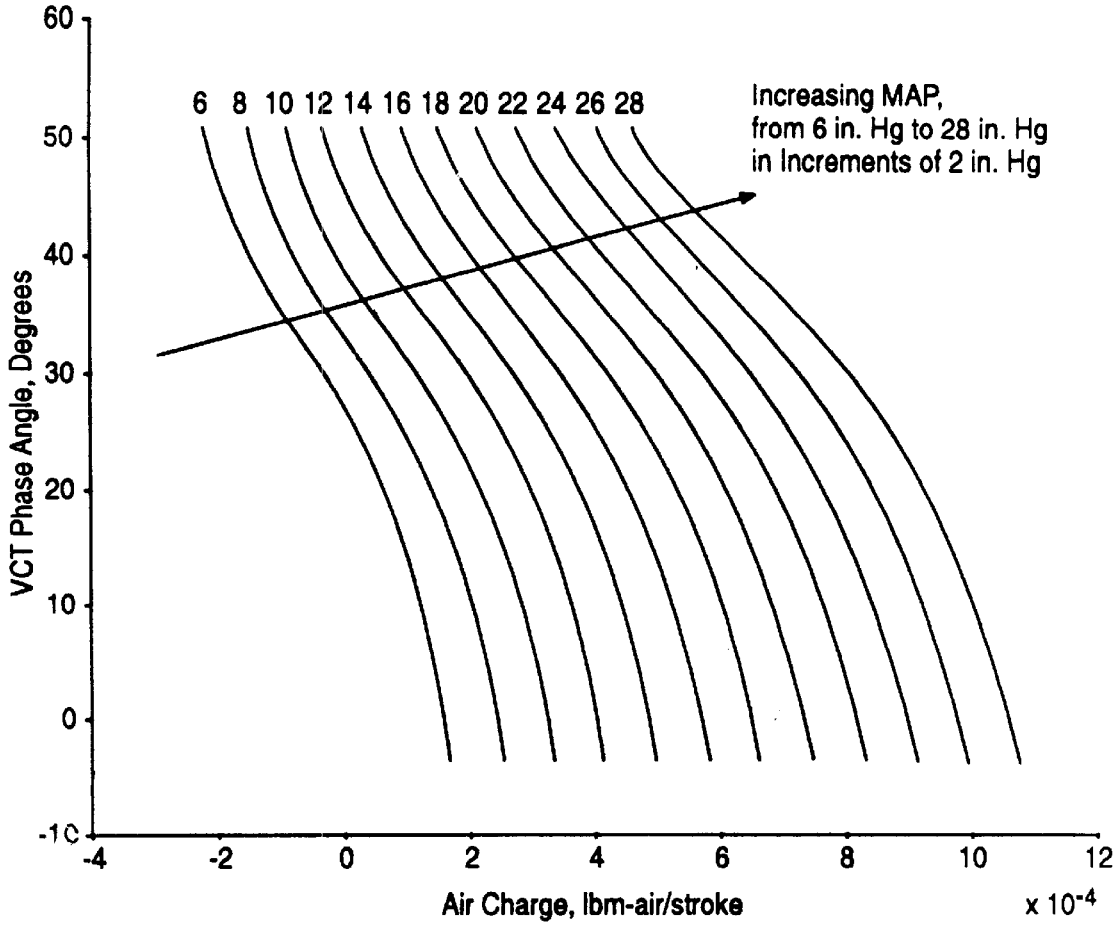
FIG. 4 is an exemplary plot of VCT phase angle versus air charge in accordance with the present invention.

The plot and underlying look-up tables in accordance with FIG. 4 are preferably generated using a third-order polynomial that expresses the relationship between desired air charge "achg" and VCT phase angle as a at a given MAP:

$$VCT \text{ Phase Angle } (MAP)=C_0+C_1*(achg)+C_2*(achg)^2+C_3*(achg)^3$$

Such a relationship is developed and described in detail by A. G. Stefanopoulou, J. A. Cook, J. W. Grizzle and J. S. Freudenberg, in "Control-Oriented Model of a Dual Equal Variable Cam Timing Spark Ignition Engine," Journal of Dynamic Systems, Measurement and Control, which is herein incorporated by reference in its entirety.

FIG. 4 thus represents plots generated using twelve different sets of coefficients $C_0$ through $C_3$, i.e., one set each corresponding to each of the curves of the figure. Preferably, each of the coefficients are selected as a function of engine speed and MAP. As shown, VCT phase angle versus air charge curves are provided at increments of 2 in. Hg for MAP values ranging between 6 in. Hg and 28 in. Hg.

Referring again to FIG. 3, the controller adjusts or "arbitrates" the desired VCT phase angle, step 306, to further avoid uneven torque responses and to operate the VCT mechanism within its physical limitations. The VCT phase angle is preferably adjusted by "rate limiting", which refers to the limiting the rate of change of the VCT phase angle to an acceptable range, and/or "clipping", which refers the limiting of the magnitude of the VCT phase angle within an allowable range of values. The extent to which the VCT phase angle is clipped or rate limited depends on several factors including combustion stability, available oil pressure and other physical limitations of the VCT mechanism.

Figure 5:
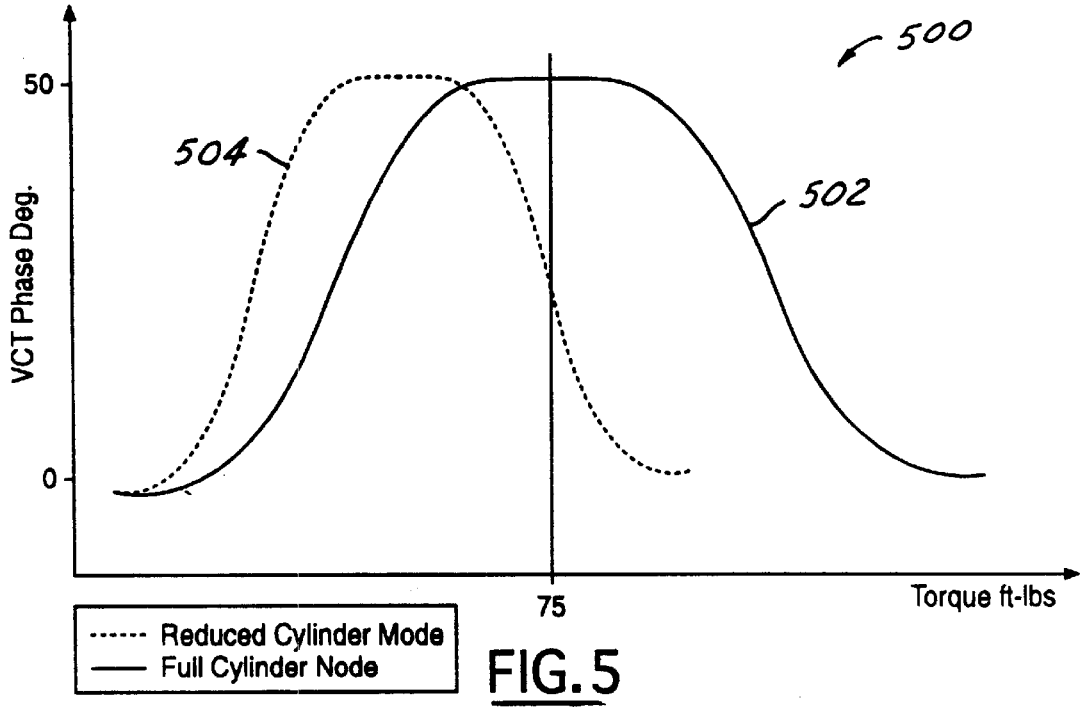
FIG. 5 an exemplary plot of maximum allowable VCT phase angles in accordance with the present invention.

FIG. 5 shows maximum allowable VCT phase angles as a function of engine torque for full and reduced cylinder modes, plots 502 and 504 respectively. The VCT control command is then applied, step 308, to reduce or increase engine torque accordingly when the intake manifold pressure is higher or lower that what it should be for a desired engine torque.

Next, in order to further tune the engine torque output, the actual torque output of the engine is estimated as a function of the current spark timing, fuel pulse width and the current VCT phase angle, step 310. The difference between the estimated torque output of the engine and the driver demanded torque output is then computed, step 321, and this value is used to derive a spark adjustment command to adjust the estimated torque output of the engine to the desired torque output, step 314. The spark adjustment command is then applied to the ignition system or spark timing system of the engine, step 316.

Figure 6:
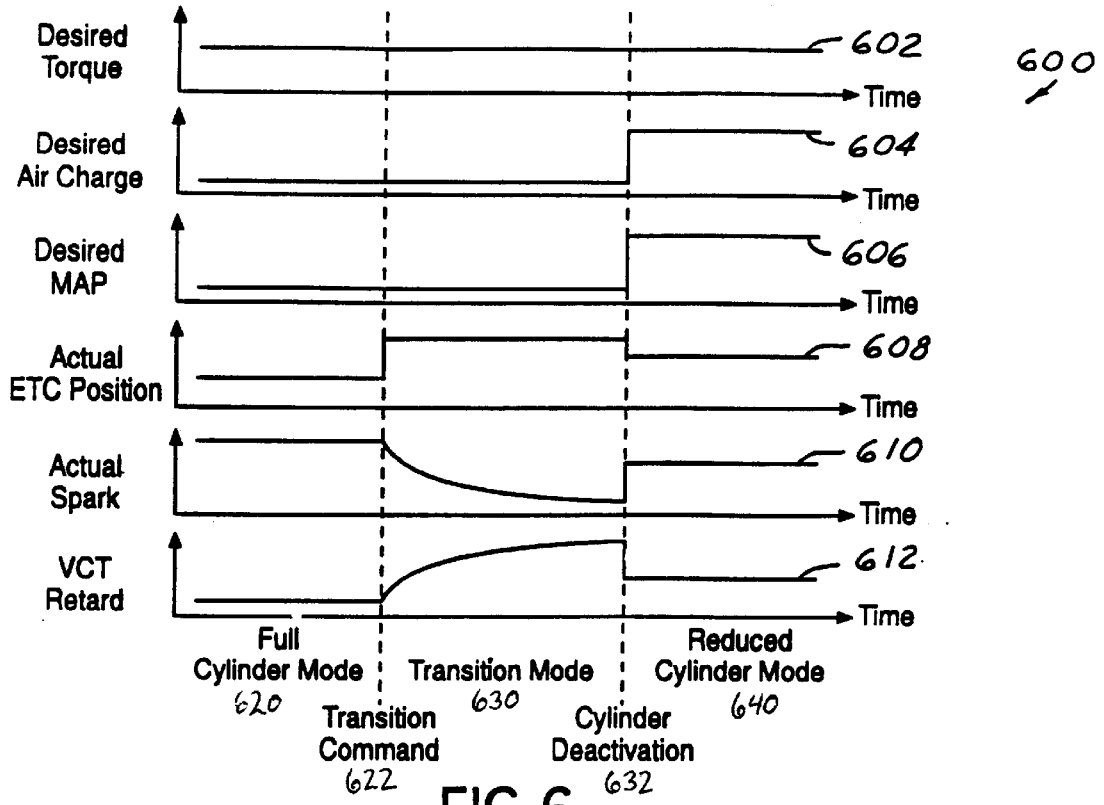
FIG. 6 is a timing diagram illustrating a transition from full cylinder mode operation to reduced cylinder mode operation of a variable displacement engine.
Figure 7:
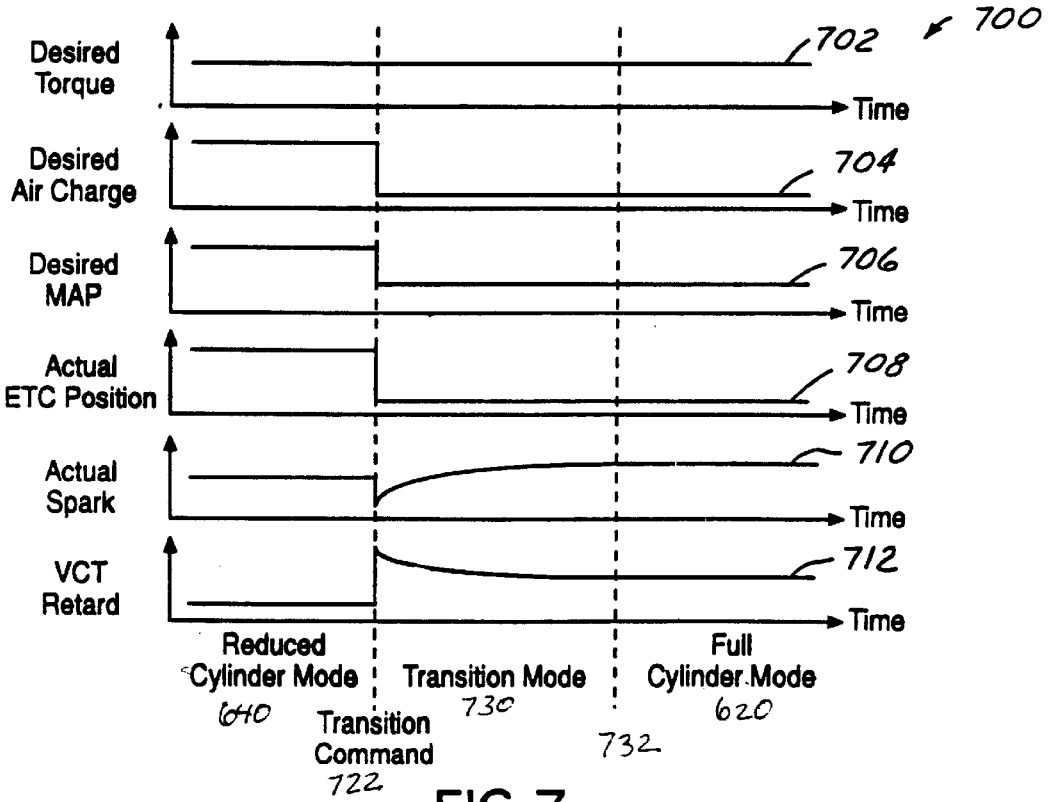
FIG. 7 is a timing diagram illustrating a transition from reduced cylinder mode operation to full cylinder mode operation of a variable displacement engine.

FIGS. 6 and 7 are timing diagrams illustrating the method of the present invention as applied, for example, to an engine having dual equal variable cam timing (DEVCT) actuator. FIG. 6 shows the timing of events associated with the transition of operation from full cylinder mode to reduced cylinder mode, whereas FIG. 7 shows a transition from reduced cylinder mode to full cylinder mode.

Referring to FIG. 6, when the engine's powertrain control logic issues a command 622 to transition from full cylinder mode 620 to reduced cylinder mode 640, the engine must first enter a transition mode 630 prior to the deactivation of designated cylinders. As qualitatively shown by traces 602 and 604, the driver-demanded torque is desired to remain constant before, during and after transition from full to reduced modes. When the cylinder or cylinders are deactivated, the desired air charge and thus MAP for the activated cylinders must increase as shown by traces 604 and 606 in order to maintain a constant engine torque output. Accordingly, the engine's electronic throttle is opened to increase the MAP from a full cylinder mode level to a reduced cylinder mode or target level as shown by trace 608. Once the target MAP is achieved, the designated cylinders are deactivated at 632 as indicated by FIG. 6. The reason for increasing the MAP, or so-called "filling" the intake manifold, is to achieve a MAP level that will provide the driver-demanded torque immediately upon deactivation of designated cylinder.

However, the increasing MAP immediately prior to deactivation of designated cylinders has the undesired effect of generating torque in excess of the driver-demanded torque. As such, a VCT phase angle (VCT cam retard) is applied as shown by trace 612 to reduce engine torque output during the transition mode 630 when the intake manifold air pressure is higher required to achieve the desired driver-demanded torque.

Application of the VCT retard alone thereby provides an additional control parameter and thus greater flexibility for reducing engine torque, while at the same time minimizing fuel consumption that would otherwise result by using only spark retard techniques to reduce engine torque. However, if the degree of torque reduction is so great, VCT retard can optionally be used with spark retard as suggested by trace 610 to enhance torque reduction during the transition mode.

Similarly, with reference to traces 702, 704 and 706 of FIG. 7, an engine in a reduced cylinder mode requires a different manifold pressure to produce the driver-demanded torque when compared to the same engine in full cylinder mode. This is because cylinder load changes with the number of activated and deactivated cylinders for the required constant engine torque output. In contrast to the transition scenario of FIG. 6, when transitioning from a reduced cylinder mode 640 to a full cylinder mode 620, the transition mode 730 is initiated by the actual activation of the designated cylinders at time 722. ETC position, spark retard and the VCT phase angle is then controlled as shown by traces 708, 710 and 712 until a target MAP is achieved corresponding to full cylinder mode operation. The transition mode 730 then terminates at time 732 when the target MAP has been attained.

As such, a method and system for transitioning operation of a variable displacement engine from a full cylinder mode to a reduced cylinder mode and visa-versa has been described.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed:

1. A method of operating an internal combustion engine having a variable cam timing (VCT) mechanism in cooperation with a plurality of deactivatable cylinders and corresponding intake valves, comprising:

scheduling a transition mode of the engine from a first cylinder mode to a second cylinder mode;

determining a desired engine torque during the transition mode;

determining a VCT phase angle based on the desired engine torque;

operating the VCT mechanism in accordance with the VCT phase angle to provide the desired engine torque during the transition mode; and limiting one or both of a rate of change of the VCT phase angle and a magnitude of the VCT phase angle.

2. The method according to claim 1, wherein said step of determining the desired engine torque comprises the step of determining a desired cylinder air charge required to produce the desired engine torque.

3. The method according to claim 2, wherein the VCT phase angle is a function of the cylinder air charge.

4. The method according to claim 1, further comprising. the step of applying a spark retard to provide the desired cylinder air charge during the transition mode.

5. An article of manufacture for operating an internal combustion engine having an intake manifold, an electronic throttle, an ignition system and a variable cam timing mechanism in cooperation with a plurality of deactivatable cylinders, the article of manufacture comprising:

a computer usable medium; and a computer readable program code embodied in the computer usable medium for directing a computer to control the steps of scheduling a transition mode of the engine, determining a desired engine torque during the transition mode, determining a VCT phase angle based on the desired engine torque, operating the VCT mechanism in accordance with the VCT phase angle to provide the desired engine torque during the transition mode, and limiting one or both of a rate of change of the VCT phase angle and a magnitude of the VCT phase angle.

6. A method of transitioning operation of a variable displacement internal combustion engine from a first cylinder mode to a second cylinder mode, the engine having an electronic throttle, an ignition system and a variable cam timing (VCT) mechanism in cooperation with a plurality of deactivatable cylinders and corresponding intake valves, the method comprising;

scheduling a transition from the first cylinder mode to the second cylinder mode;

determining a cylinder air charge required to produce a desired engine torque output during the transition;

operating the electronic throttle to provide the desired cylinder air charge during the scheduled transition;

determining a VCT phase angle, based on the desired cylinder air charge, required to maintain the desired engine torque output during the transition; and applying the VCT phase angle to the VCT to maintain the desired engine torque output during the transition.

7. The method according to claim 6, further comprising the steps of:

determining an actual engine torque output based at least in part on the applied VCT phase angle;

determining a torque adjustment equal to the difference between the desired engine torque output and the actual engine torque output;

operating the ignition system as required to provide the torque adjustment.

8. The method according to claim 6, further comprising the step of limiting a rate of change of the VCT phase angle.

9. The method according to claim 6, further comprising the step of limiting a magnitude of the VCT phase angle.

10. A system for operating an internal combustion engine having an intake manifold, an electronic throttle, an ignition system and a variable cam timing mechanism in cooperation with a plurality of deactivatable cylinders, the system comprising:

at least one sensor for providing signals indicative of engine manifold absolute pressure (MAP); and a controller coupled to the sensor for receiving a signal from the MAP sensor, said controller comprising:

means for scheduling a transition mode of the engine;

means for determining a desired engine torque during the transition mode;

means for determining a VCT phase angle based on the desired engine torque; and means for operating the VCT mechanism in accordance with the VCT phase angle to provide the desired engine torque during the transition mode.

11. The system according to claim 10, wherein said controller further comprises means for limiting a rate of change of the VCT phase angle.

12. The system according to claim 10, wherein said controller further comprises means for limiting a magnitude of the VCT phase angle.

13. The system according to claim 10, wherein said controller further comprises:

means for determining an actual engine torque output based at least in part on the applied VCT phase angle;

means for determining a torque adjustment equal to the difference between the desired engine torque output and the actual engine torque output;

means for operating the ignition system as required to provide the torque adjustment.

14. The system according to claim 10, wherein the VCT phase angle is a function of cylinder air charge.

15. The system according to claim 14, wherein the said function is a third-order polynomial having coefficients dependent on engine speed and MAP.

* * * * *